US011530890B2

(12) United States Patent
Wheeler et al.

(10) Patent No.: US 11,530,890 B2
(45) Date of Patent: Dec. 20, 2022

(54) APPARATUS AND METHOD FOR REGULATING FIREARM DISCHARGE GASES AND MOUNTING A COMPONENT TO A FIREARM

(71) Applicant: Maxim Defense Industries, LLC, St. Cloud, MN (US)

(72) Inventors: Joseph Wheeler, Bruneau, ID (US); Jacob Kunsky, Bruneau, ID (US); Travis Bundy, St. Cloud, MN (US)

(73) Assignee: Maxim Defense Industries, LLC, St. Cloud, MN (US)

( * ) Notice: Subject to any disclaimer, the term of this patent is extended or adjusted under 35 U.S.C. 154(b) by 389 days.

(21) Appl. No.: 16/689,037

(22) Filed: Nov. 19, 2019

(65) Prior Publication Data

US 2020/0240737 A1 Jul. 30, 2020

Related U.S. Application Data

(60) Provisional application No. 62/777,739, filed on Dec. 10, 2018.

(51) Int. Cl.
*F41A 21/34* (2006.01)

(52) U.S. Cl.
CPC ..... *F41A 21/34* (2013.01)

(58) Field of Classification Search
CPC ..... F41A 21/30; F41A 21/34; F41A 21/36; F41A 21/38
See application file for complete search history.

(56) References Cited

U.S. PATENT DOCUMENTS 2,150,161 A * 3/1939 Green ..... F41A 21/34 89/14.3
2,351,037 A * 6/1944 Green ..... F41A 21/34 89/14.5
2,499,428 A * 3/1950 Belle ..... F41A 21/36 89/14.3

(Continued)

FOREIGN PATENT DOCUMENTS

DE 10 2011 010 639 A1 9/2012
FR 793373 1/1936

(Continued)

*Primary Examiner* — Joshua T Semick
(74) *Attorney, Agent, or Firm* — Law Office of Arthur M. Antonelli, PLLC

(57) ABSTRACT

A muzzle booster or similar device for regulating firearm discharge gases from an autoloading firearm is disclosed. The muzzle booster may include a shroud and an interior component. The interior component may include a blast baffle that is configured and dimensioned to provide internal and external geometries such that exhaust pressure within the gas system is extended as a function of time to increase the overall minimum pressure impulse from the gas system into the operating mechanism of the host firearm. The blast baffle or interior component may be of M baffle type, K baffle type, or other baffle design, including monocore designs, or baffle designs integrated into monocore designs. The shroud and the interior component may cooperate with the barrel of the host firearm to form a taper lock system for securing the muzzle booster or device to the host firearm barrel.

19 Claims, 9 Drawing Sheets

(56) References Cited

U.S. PATENT DOCUMENTS

| | | | | |
|---|---|---|---|---|
| 3,714,864 | A * | 2/1973 | Thierry | F41A 21/38 89/14.3 |
| 4,813,333 | A | 3/1989 | Garris et al. | |
| 4,893,426 | A | 1/1990 | Bixler | |
| 5,305,677 | A | 4/1994 | Kleinguenther et al. | |
| 5,559,302 | A | 9/1996 | Latka | |
| RE35,381 | E | 11/1996 | Rose | |
| 5,631,438 | A | 5/1997 | Martel | |
| D384,389 | S | 9/1997 | Cyktich | |
| 5,685,102 | A | 11/1997 | Latka | |
| D425,184 | S | 5/2000 | Lidgett | |
| 6,425,310 | B1 | 7/2002 | Champion | |
| 6,516,698 | B1 | 2/2003 | Poff, Jr. | |
| 6,820,530 | B2 | 11/2004 | Vais | |
| D507,619 | S | 7/2005 | Shiloni | |
| 7,677,150 | B2 | 3/2010 | Dater et al. | |
| 7,836,809 | B2 * | 11/2010 | Noveske | F41A 21/34 89/14.4 |
| D632,751 | S | 2/2011 | Bowers et al. | |
| 7,891,282 | B1 | 2/2011 | DeGroat | |
| D641,450 | S | 7/2011 | Ding | |
| D642,650 | S | 8/2011 | Oliver | |
| D643,087 | S | 8/2011 | Oliver | |
| 8,156,855 | B2 | 4/2012 | Anderson | |
| 8,186,261 | B2 | 5/2012 | McNeill et al. | |
| 8,272,306 | B1 | 9/2012 | Smith | |
| 8,291,805 | B1 | 10/2012 | Quilligan | |
| 8,387,299 | B1 * | 3/2013 | Brittingham | F41A 21/30 89/14.4 |
| 8,424,441 | B2 | 4/2013 | Brittingham et al. | |
| D682,384 | S | 5/2013 | Jaureguizar | |
| D682,974 | S | 5/2013 | Honigmann | |
| D694,355 | S | 11/2013 | Hormann | |
| 8,714,300 | B2 | 5/2014 | Johansen | |
| D709,140 | S | 7/2014 | Coulter | |
| D719,646 | S | 12/2014 | Melo | |
| 8,950,546 | B2 | 2/2015 | Shults et al. | |
| 8,997,621 | B1 | 4/2015 | Dater et al. | |
| D743,007 | S | 11/2015 | Kimura | |
| 9,175,919 | B2 | 11/2015 | Russell et al. | |
| 9,239,201 | B1 | 1/2016 | Reis Green | |
| 9,395,137 | B2 * | 7/2016 | Miller, III | F41A 21/34 |
| 9,410,761 | B2 | 8/2016 | Morris et al. | |
| D767,076 | S | 9/2016 | Bebee | |
| D773,587 | S | 12/2016 | Underwood | |
| 9,513,078 | B1 | 12/2016 | Fulton et al. | |
| D776,226 | S | 1/2017 | Green | |
| D778,386 | S | 2/2017 | Farthing et al. | |
| D778,387 | S | 2/2017 | Farthing | |
| D779,618 | S | 2/2017 | Farthing | |
| D782,598 | S | 3/2017 | Faxon | |
| 9,658,019 | B2 | 5/2017 | Smith | |
| D788,873 | S | 6/2017 | Wiley | |
| D789,480 | S | 6/2017 | Olsen | |
| D792,545 | S | 7/2017 | Green et al. | |
| 9,739,560 | B1 | 8/2017 | Salvador | |
| 9,746,267 | B2 | 8/2017 | Smith | |
| 9,791,247 | B2 | 10/2017 | Parker | |
| D802,699 | S | 11/2017 | Shults | |
| D802,700 | S | 11/2017 | Shults | |
| D807,461 | S | 1/2018 | Cheng et al. | |
| D808,490 | S | 1/2018 | Meinert | |
| D811,513 | S | 2/2018 | Payton | |
| 9,958,227 | B2 | 5/2018 | Whitson | |
| D825,845 | S | 8/2018 | Dittmer et al. | |
| 10,156,411 | B2 | 12/2018 | Thompson et al. | |
| 10,184,744 | B2 | 1/2019 | Young et al. | |
| 10,184,745 | B1 | 1/2019 | Fulton | |
| 10,228,210 | B2 | 3/2019 | Parker | |
| 10,281,228 | B1 | 5/2019 | Marfione | |
| 10,330,417 | B2 | 6/2019 | Reis Green et al. | |
| 10,458,738 | B2 * | 10/2019 | Albino | F41A 21/30 |
| 10,480,884 | B2 | 11/2019 | Smith | |
| 10,480,888 | B2 * | 11/2019 | Barrett | F41A 21/28 |
| 10,502,513 | B2 * | 12/2019 | Ellison | F41A 21/30 |
| 10,508,878 | B1 * | 12/2019 | Oglesby | F41A 21/36 |
| 10,605,558 | B1 | 3/2020 | Marfione et al. | |
| 10,619,962 | B1 | 4/2020 | Hatfield | |
| 10,969,187 | B2 | 4/2021 | DeJessa | |
| 10,996,015 | B2 | 5/2021 | Lee | |
| 11,243,040 | B2 | 2/2022 | Honigmann et al. | |
| 11,287,207 | B2 | 3/2022 | DeJessa | |
| 2008/0148928 | A1 | 6/2008 | McClellan | |
| 2010/0294118 | A1 | 11/2010 | Hortobagyi | |
| 2011/0271575 | A1 | 11/2011 | Overbeek Bloem et al. | |
| 2012/0228052 | A1 | 9/2012 | Findlay | |
| 2012/0279381 | A1 | 11/2012 | Landolt | |
| 2013/0312592 | A1 | 11/2013 | Storrs et al. | |
| 2016/0161203 | A1 | 6/2016 | Wilson | |
| 2016/0370157 | A1 | 12/2016 | Parker | |
| 2017/0205175 | A1 | 1/2017 | Garst et al. | |
| 2017/0102201 | A1 | 4/2017 | Bush | |
| 2017/0160034 | A1 | 6/2017 | Parker | |
| 2017/0321984 | A1 | 11/2017 | Palu et al. | |
| 2018/0120045 | A1 | 5/2018 | Rost | |
| 2018/0252489 | A1 | 9/2018 | Parker | |
| 2020/0224989 | A1 * | 7/2020 | Bundy | F41A 21/325 |
| 2020/0248980 | A1 | 8/2020 | Bragais | |
| 2021/0389074 | A1 | 12/2021 | Green et al. | |

FOREIGN PATENT DOCUMENTS

| | | |
|---|---|---|
| WO | WO 2017/102012 A1 | 6/2017 |
| WO | WO 2017/102132 A1 | 6/2017 |

* cited by examiner

APPARATUS AND METHOD FOR REGULATING FIREARM DISCHARGE GASES AND MOUNTING A COMPONENT TO A FIREARM

CROSS REFERENCE TO RELATED APPLICATIONS

This application claims the benefit of U.S. Provisional Application No. 62/777,739 filed Dec. 10, 2018. U.S. Provisional Application No. 62/777,739 is incorporated by reference herein in its entirety.

FIELD OF THE INVENTION

The invention generally relates to firearms. More particularly, the invention relates to a muzzle booster, suppressor (e.g., a firearm suppressor, silencer, muffler), or similar devices.

BACKGROUND

Firearms may have accessories attached to their muzzles. These accessories may include flash hiders, muzzle brakes, suppressors, or other devices for regulating firearm discharge gases. Generally, these devices may be timed with shims or a crush washer. A need exists, however, for new muzzle accessories, as well as new mounting and timing methods for same.

SUMMARY

Hence, the present invention is generally directed toward an apparatus and method for regulation of firearm discharge gases. In an exemplary embodiment, a muzzle booster is disclosed. The disclosed embodiment may regulate firearm discharge gases to increase sound signature suppression of a host firearm, decrease flash signature of a host firearm, reduce recoil to a shooter from a host firearm, and provide a mechanism for adjusting the cyclic rate of the firearm. Additionally, the muzzle booster may include a housing that is configured for use inside a handguard that extends beyond the muzzle of the host firearm.

A muzzle booster for regulating firearm discharge gases from a firearm. The muzzle booster including a shroud and a core positioned in the shroud. The shroud may include a proximal end, an interior conical segment adjacent the proximal end, and a distal end which comprises a first diameter. Additionally, the core may include a receptacle for receiving the muzzle of a firearm, a venting port disposed adjacent to the receptacle, a bore opposite the receptacle and concentrically aligned with the receptacle, and a blast baffle disposed around the bore. The blast baffle may include a distal end surface, an internal cone adjacent to the distal end surface, the bore and the internal cone being in fluid communication, and a ring segment adjacent to the distal end surface. The ring segment and the distal end of the shroud may be spaced from each other radially by a gap. The gap may be substantially equal to 0.004 inches. Moreover, the core and the shroud define a blast chamber intermediate to the shroud and the core. Additionally, the receptacle may include a screw thread.

The blast chamber may have a volume substantially equal to 1.622 cubic inches. Further, the blast chamber may have a tuning factor ranging from approximately 24.622 $in^2$ to approximately 33.313 $in^2$. The tuning factor may be substantially equal to 28.967 $in^2$. Additionally, the muzzle booster may further include a bore, and the bore may have an inner diameter which ranges from approximately 0.238 inches and approximately 0.280 inches. Indeed, the inner diameter may be substantially equal to 0.280 inches.

A method for improving operational reliability of an autoloading firearm system is further disclosed. The method may include providing a muzzle booster in accordance with this disclosure, as well as providing an autoloading firearm which comprises a barrel. The method may further include fixing the muzzle booster to the barrel of the firearm, as well as affixing the muzzle booster to a barrel securely via taper lock.

DESCRIPTION OF THE DRAWINGS

In the accompanying drawings, which form part of this specification and are to be read in conjunction therewith and in which like reference numerals are used to indicate like parts in the various views.

DESCRIPTION

Figure 1:
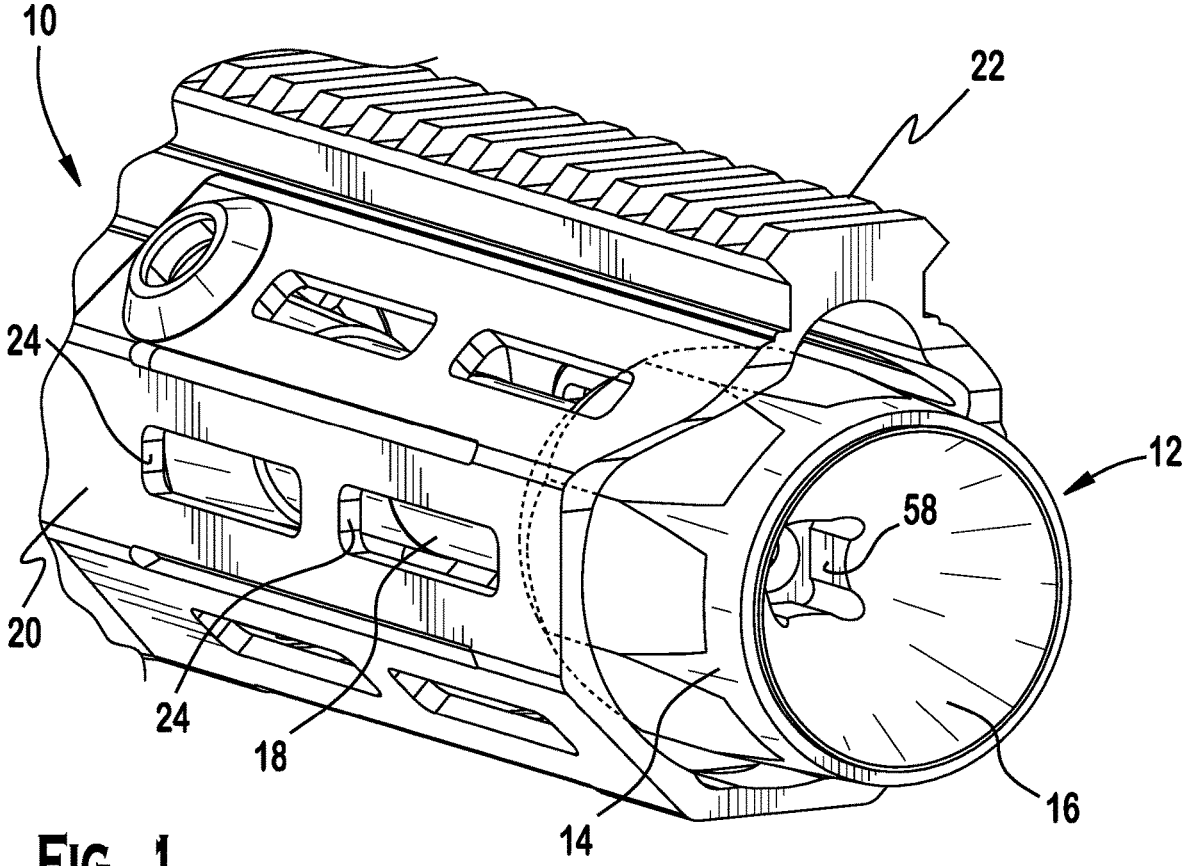
FIG. 1 is a partial perspective view of a short barrel rifle with an exemplary embodiment of a muzzle booster in accordance with the present invention.
Figure 6:
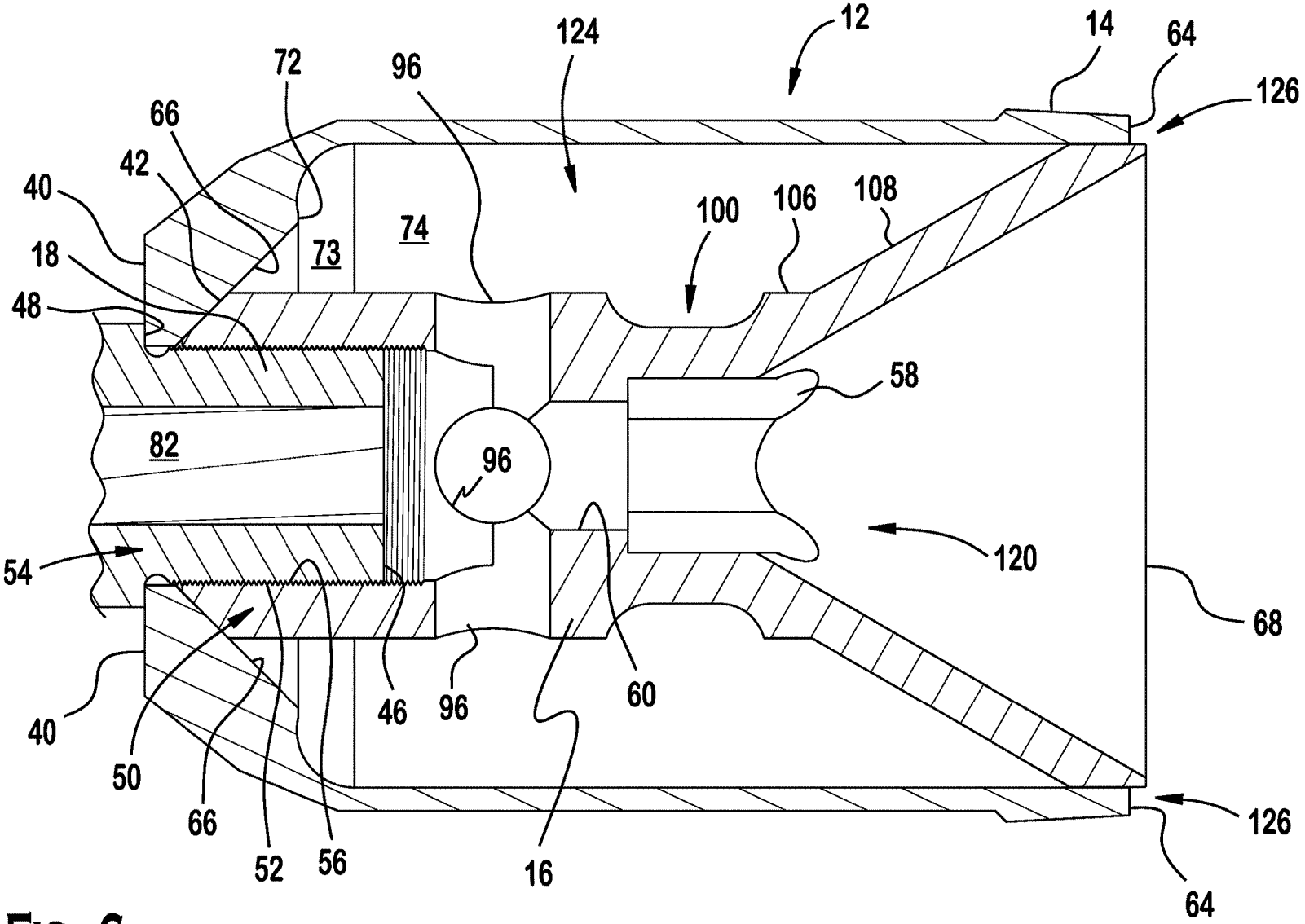
FIG. 6 is a cross-sectional view of the muzzle booster and barrel assembly of FIG. 3.

FIG. 1 shows a firearm 10 with an illustrative embodiment of a muzzle booster 12 in accordance with the present invention. The muzzle booster 12 may include a shroud (or housing) 14 and a core 16 (or internal component). Referring to FIG. 6, the muzzle booster may be mounted on the barrel 18 of the firearm. The barrel 18 may be a short barrel, and the firearm may include a handguard 20. In the exemplary embodiment, the barrel may be 5.5 inches in length and may be chambered for 5.56×45 mm NATO ammunition cartridges. Generally, the muzzle booster 12 may regulate firearm discharge gases to adjust the cyclic rate of the firearm. Additionally, the muzzle booster 12 may increase sound signature suppression of the host firearm, decrease flash signature of the host firearm, and reduce recoil. In other embodiments, the muzzle booster 12 may be configured and dimensioned for integration with barrels of other lengths or with chambering for other ammunition types.

Figure 2:
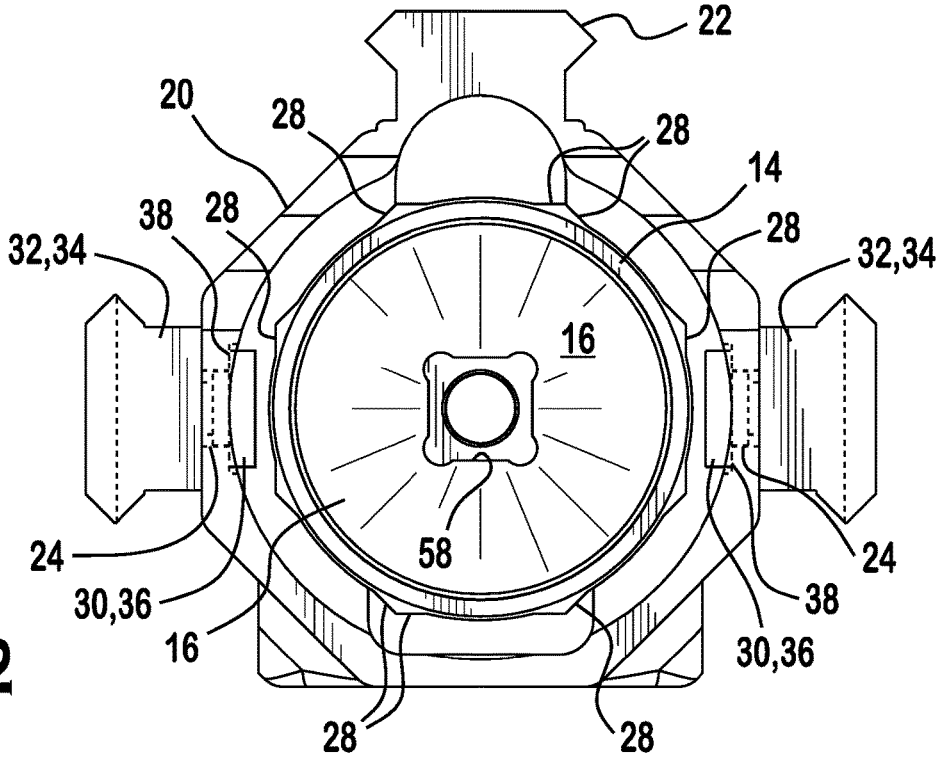
FIG. 2 is front view of the short barrel rifle and muzzle booster of FIG. 1.

As shown in FIG. 1 and FIG. 2, the muzzle booster 12 may be received within the handguard 20. The handguard 20 may include an integral accessory rail 22 for mounting an optical sight, back up sights or other accessories. Also, the handguard 20 may include a plurality of slots 24 for mounting additional accessories, such as Picatinny rail sections, hand stops, grips, lasers, flashlights and other tactical accessories.

As shown in FIG. 2 the exterior surface of the muzzle booster housing 26 may include a planar surface 28 under each respective row of handguard slots 24. In this fashion, the shroud (or muzzle booster housing) 14 may present a truncated or shallow profile to accommodate hardware 30 which may be used to secure an accessory 32 to interior portions of the handguard 20 through one or more slots 24 while maintaining the barrel 18 in a free floating configuration. In the exemplary embodiment, eight planar surfaces 28 may be positioned around the periphery of the shroud (or muzzle booster housing) 14. As illustrated in FIG. 2, two accessory rail sections 34 may be connected to opposing rows of handguard slots 24. Each accessory rail section may include an interior fastener 36 that secures to an inner surface 38 of the handguard 20 which abuts each slot 24. In other embodiments, the muzzle booster 12 may include any suitable number of planar surfaces 28—or no planar surfaces—as appropriate for an application, provided that the barrel 18 and muzzle booster 12—most preferably—are free floating and do not contact the handguard 20 or associated accessories 34 and hardware 30. Accordingly, the muzzle booster 12 may be deployed for service on a host firearm 10 where the muzzle booster is partially or fully concealed within the handguard 20. Further, the shroud (or muzzle booster housing) 14 may be configured and dimensioned to accommodate—without interference—the full length of fastener screws and other attachment members associated with accessories that are secured to the handguard. For instance, the housing may be configured and dimensioned to accommodate the use of M-RAX™ or M-LOK® fasteners or other fastening hardware inside the handguard.

torqued into place to a specific torque specification to secure the muzzle booster to the barrel. Referring to FIG. 1 and FIG. 2, the core 16 may include a drive socket 58 for mounting and removing the muzzle booster 12 from the barrel. In the exemplary embodiment, the drive socket 58 may be a ⅜" square fitting. Accordingly, the core 16 may include a forward facing socket or protrusion to receive or accept use of a common tool (or tools) for installation and removal from the barrel. This may include a drive socket, a screwdriver recess, or other tool types. Most preferably, the installation and removal of the muzzle booster 12 may be done when the shroud 14 is radially covered by a handguard.

Figure 3:
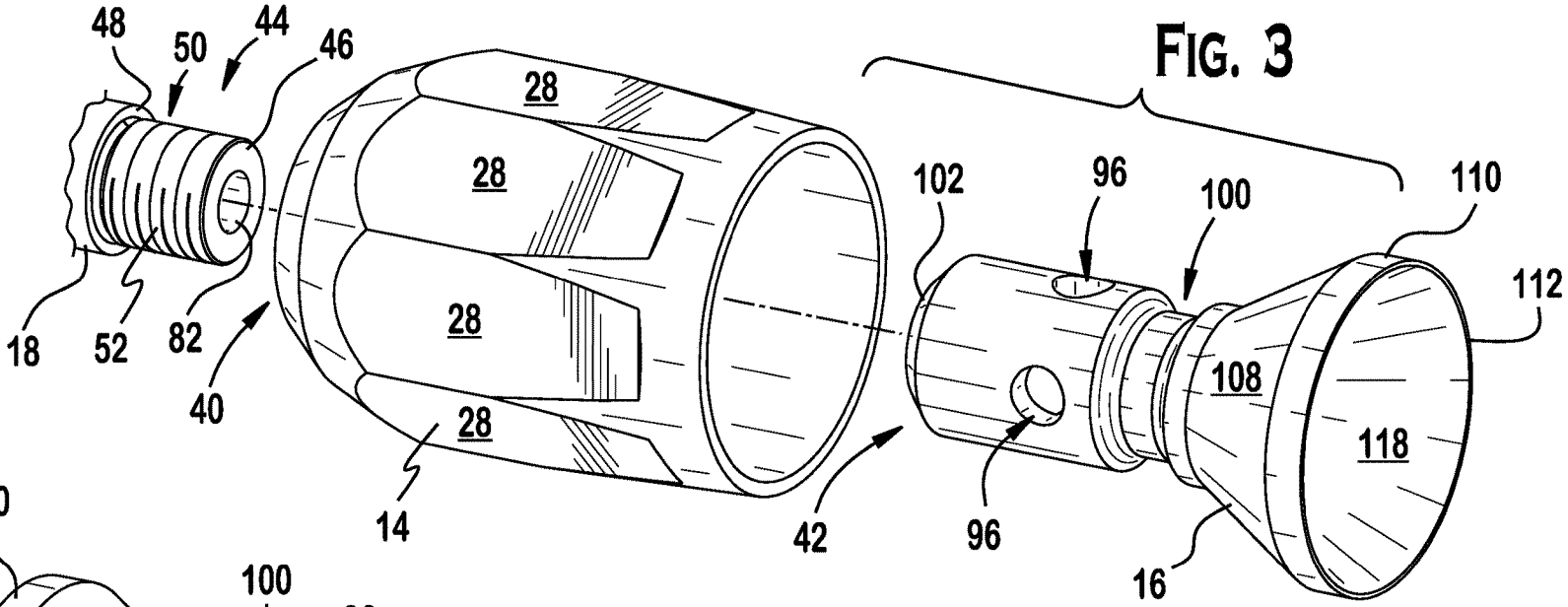
FIG. 3 is an exploded view of the muzzle booster and barrel assembly of FIG. 1.

Referring to FIG. 3 and FIG. 6, the stopping surface 48 on the barrel may be a flat annular surface. The stopping surface 48 may be disposed perpendicular to the bore 60. Similarly, referring to FIG. 9, the shroud 14 further may include a stopping surface 62. The stopping surface 62 on the shroud 14 may be flat and annular. The flat annular surface may be disposed at the proximate end 40 of shroud 14 and may be oriented perpendicular to the length of the shroud (or muzzle booster housing). The length of the shroud 14 from the proximal end 40 to the distal end 64 may be L1. The proximal surface of the shroud 14 further may include a central aperture 54. The central aperture 54 may possess a diameter D1 and a length $L_2$. Further, the shroud (or muzzle booster housing) 14 may further include an interior conical segment 66 adjacent to the proximal end 40. Preferably, the conical segment 66 may be disposed at an acute angle $\Theta_1$ with respect to the aperture 54. The distal end 69 of the conical segment may be spaced a distance $L_3$ from the proximal end 70 of the conical segment 66. The distal end 69 of the conical segment 66 may possess a diameter D2. The interior end wall immediately surrounding the conical segment 66 may form a flat annular surface 72, which may possess an outer diameter D3. The interior end wall next to the flat annular surface 72 may curve to meet the interior side wall 74. In the disclosed embodiment, the curve 73 may possess a radius $R_1$. The interior side wall 74 may possess a length L4 and a uniform diameter D4. Table 1 (below) presents values for the dimensions of the exemplary shroud identified in FIG. 9.

TABLE 1

| Exemplary Shroud Dimensions | | | | | | | | | | |
|---|---|---|---|---|---|---|---|---|---|---|
| | L1 | L2 | L3 | L4 | D1 | D2 | D3 | D4 | R1 | Θ1 |
| Value | 2.142 | 0.067 | 0.268 | 1.685 | 0.520 | 1.055 | 1.095 | 1.401 | 0.125 | 45.0 |

(a) Distances are provided in inches and the angle is provided in degrees.

Figure 4:
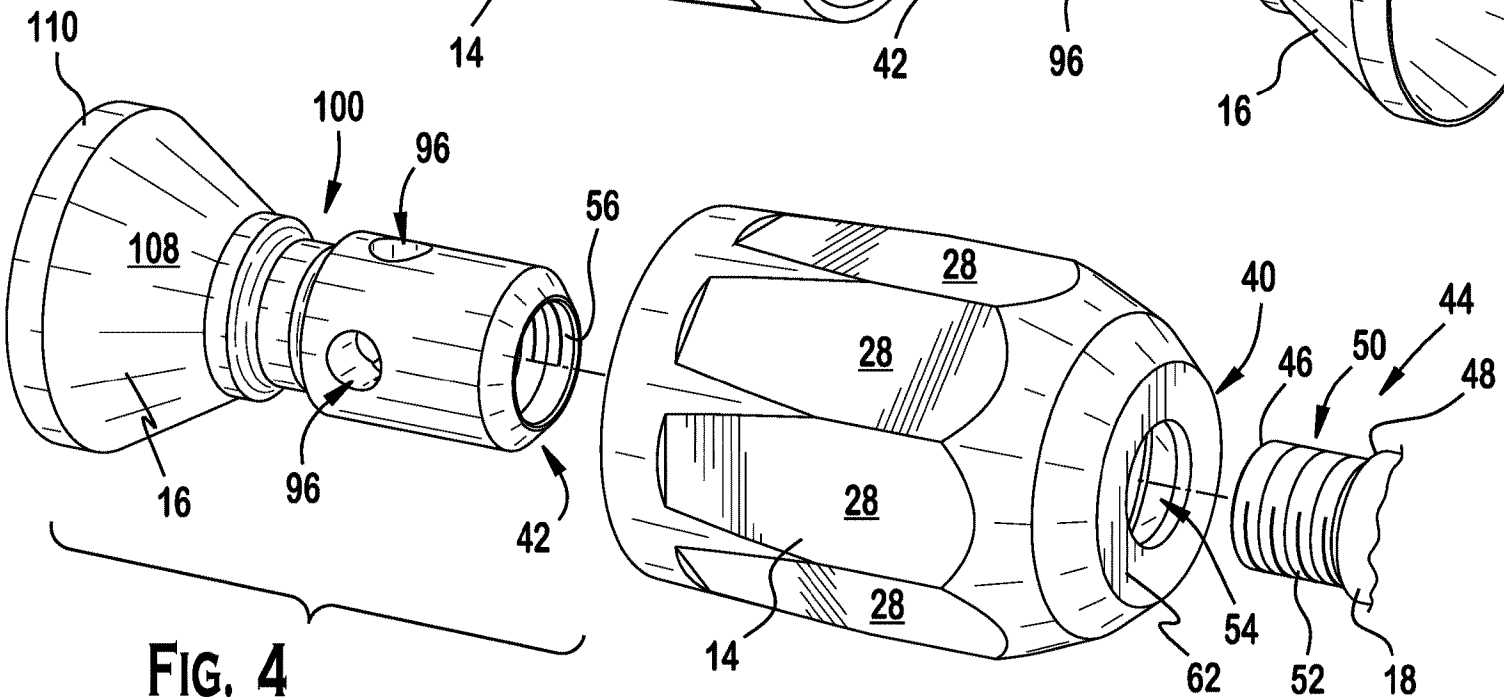
FIG. 4 is another perspective view of the muzzle booster and barrel assembly of FIG. 3.
Figure 5:
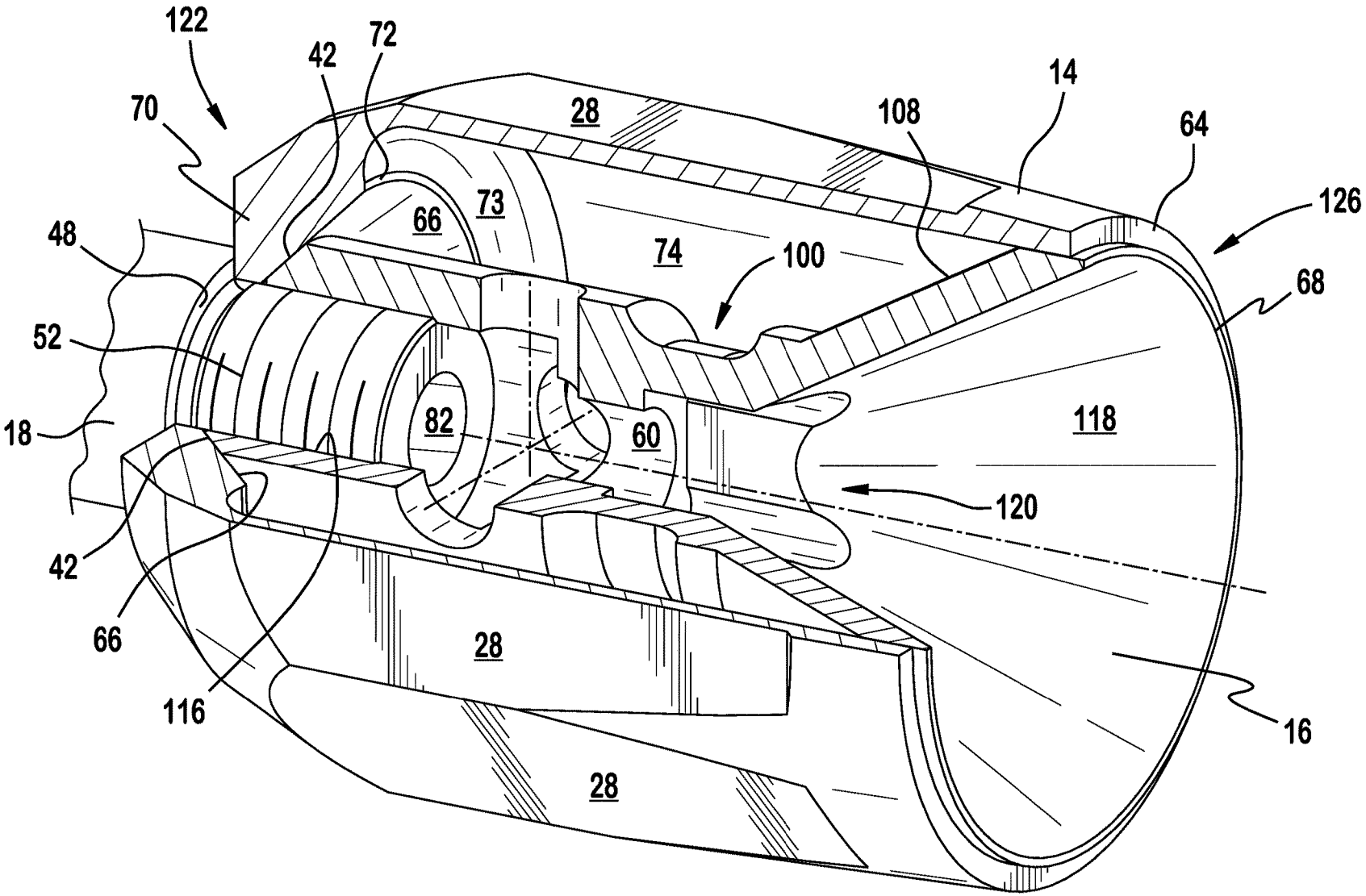
FIG. 5 is another perspective view of the muzzle booster and barrel assembly of FIG. 3.
Figure 10:
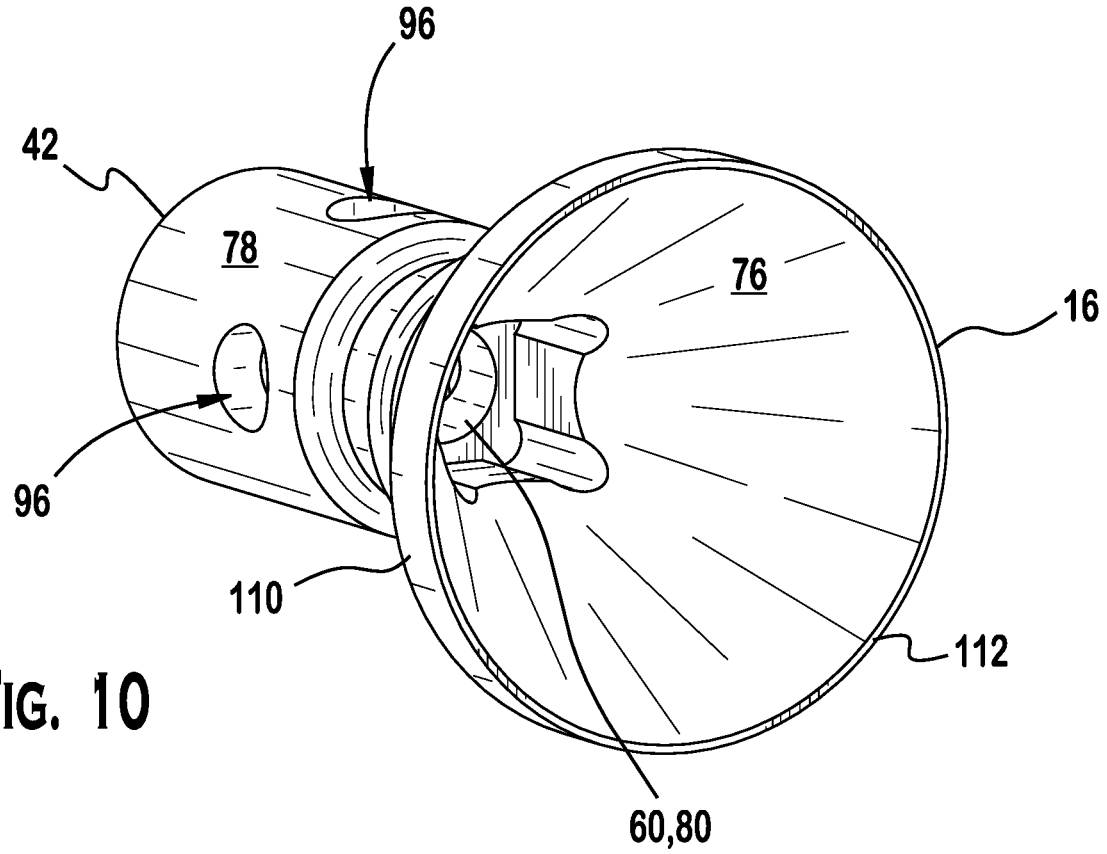
FIG. 10 is a perspective view of the interior component of the muzzle booster of FIG. 1.
Figure 11:
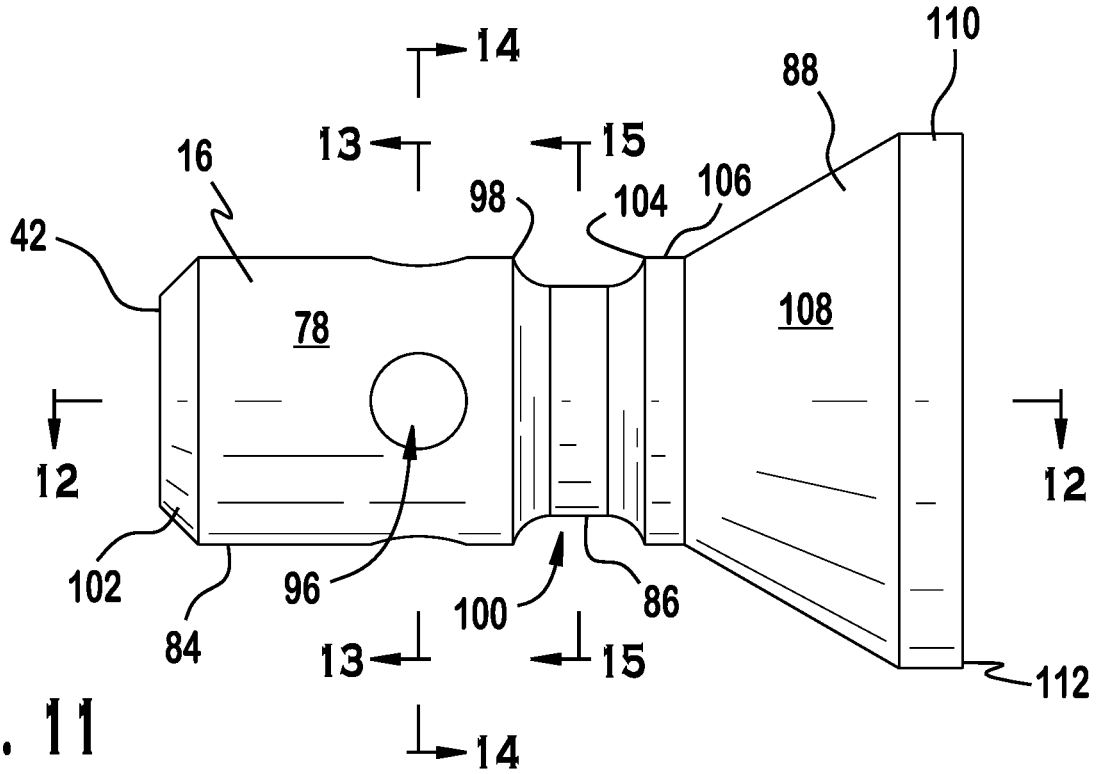
FIG. 11 is a side view of the interior component of FIG. 10.

Referring to FIGS. 3, 4 and 5, the proximal ends 40, 42 of the shroud 14 and the core 16, respectively, may be configured and dimensioned to be received on the muzzle 44 of a host firearm barrel 18. For instance, the barrel 18 may include a distal end 46 and a stopping surface 48 spaced from the distal end. The exterior surface 50 of the barrel 18 disposed between the distal end 46 and the stopping surface 48 may include a screw thread 52. The threaded barrel segment 50 may have a length of approximately 0.6 inches. Referring to FIG. 4 and FIG. 6, a central aperture 54 on the proximal end 40 of the shroud 14 may be configured and dimensioned to mount around the threaded barrel segment 50 and seat on the barrel stopping surface 48. Additionally, a threaded receptacle 56 of the core 16 may be mounted on to the threaded barrel segment 50 of the host firearm and Referring to FIG. 6 and FIG. 10, the core (or interior component) 16 may be of one piece (e.g., a monocore), with a bore 60 distal to its length to allow for unimpeded passing of a projectile (e.g., a bullet). The core 16 may include an inner surface 76, an outer surface 78, and a central passage 80 aligned with the bore 82 of the host firearm 10. Referring to FIG. 11, the outer surface 78 of the core 16 may include a base portion 84, a neck portion 86, and a conical portion 88. Internally, as shown in FIG. 12, the central passage 80 may include a proximal segment 90, a distal segment 92, and an intermediate segment 94.

Figure 12:
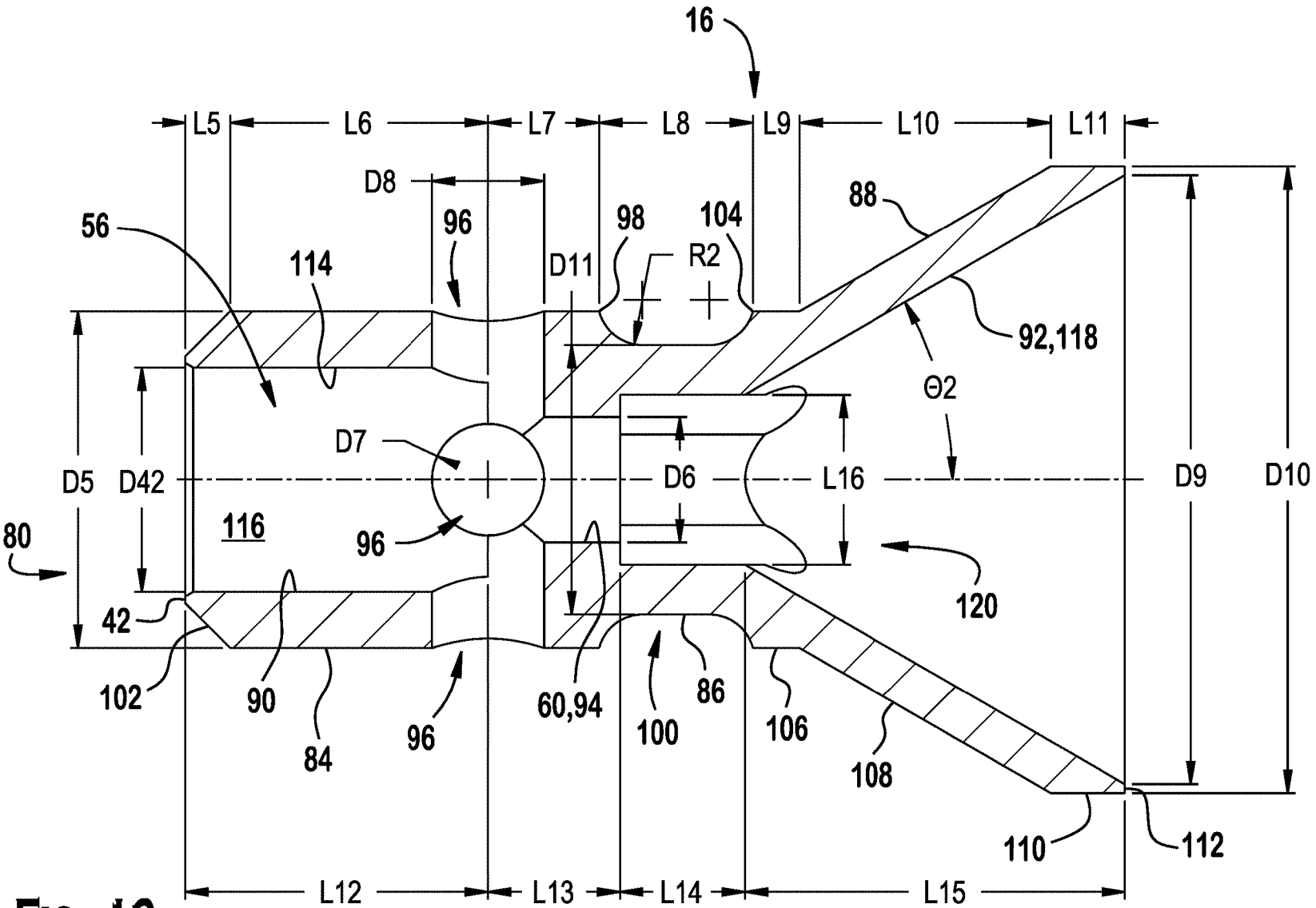
FIG. 12 is a cross-sectional view of the interior component of FIG. 11 along line 12-12.

Referring to FIG. 12, the base portion 84 of the core 16 may extend from the proximal end 42 past the venting ports 96 to a proximal inflection point 98 where the outer diameter of the core narrows to form an annular recess 100. The base portion 84 may include a proximal end surface 42, as well as a leading conical segment 102. Further, the neck portion 86 may extend from the proximal inflection point 98 to a distal inflection point 104 where the outer diameter of the core increases to match the outer diameter of the core that is generally presented throughout the base portion. The neck portion 86 may form an annular recess 100. Moreover, the conical portion 88 of the outer surface may include a ring 106 of uniform diameter, as well as a trailing conical segment 108. The trailing conical segment 108 may abut a distal ring segment 110 of uniform diameter. A distal end surface 112 of the core may be disposed adjacent to the distal ring segment. The distal end surface 112 may form a trailing annular surface.

Figure 13:
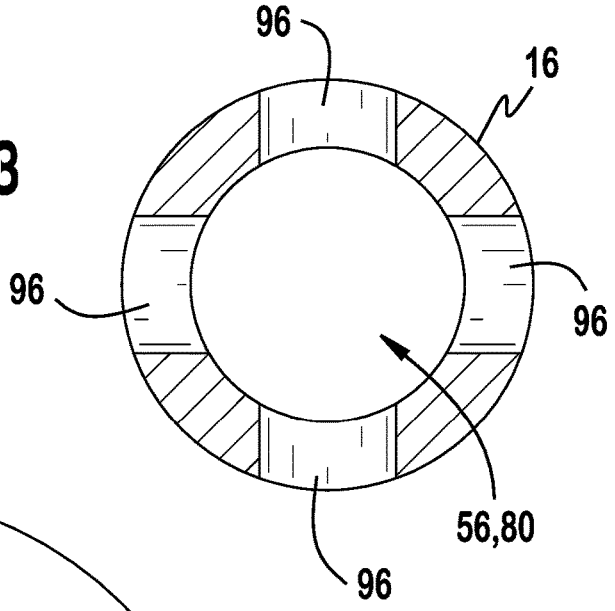
FIG. 13 is a cross-sectional view of the interior component of FIG. 11 along line 13-13.
Figure 14:
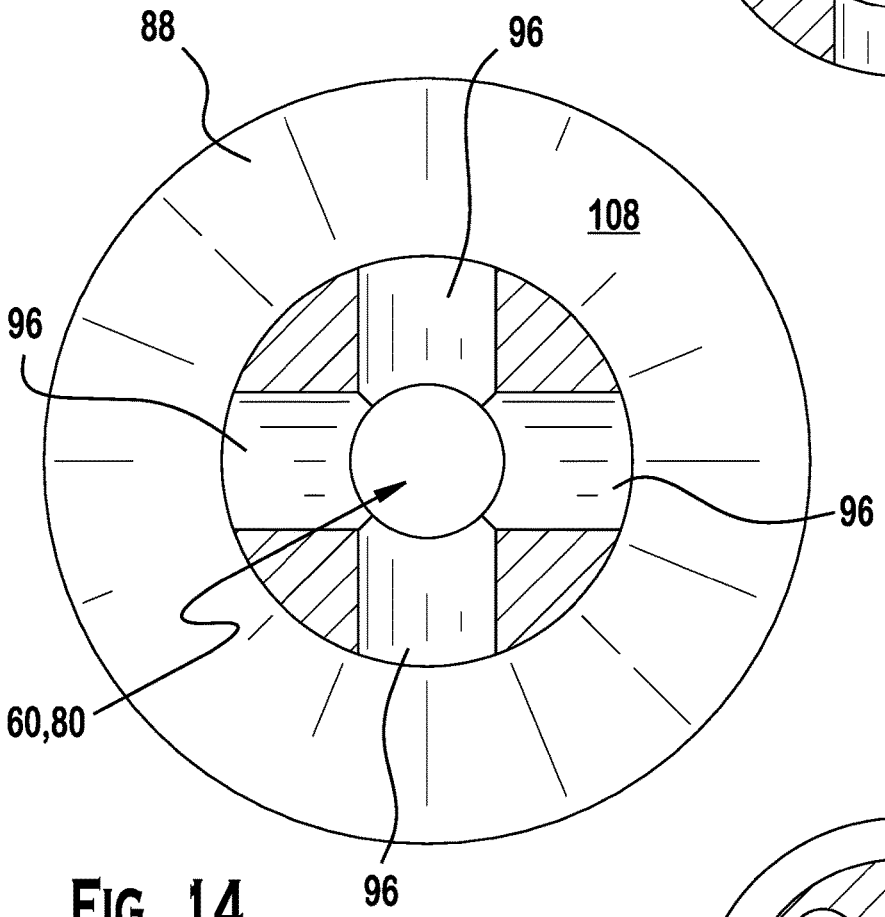
FIG. 14 is a cross-sectional view of the interior component of FIG. 11 along line 14-14.

Internally, by contrast, the proximal segment 90 of the central passage 80 may include a receptacle 56 for receiving the threaded barrel segment 50. The receptacle may extend from the proximal end 42 of the core to the mid-point of one or more radially oriented venting ports 96. The sidewall 114 of the receptacle may include a screw thread 116. The screw thread 116 on the sidewall of the receptacle may be configured and dimensioned to mate with the screw thread 52 adjacent to the distal end 46 of the barrel. The one or more venting ports 96 may fluidly connect the central passage 80 to the exterior base portion 84. The venting ports 96 may be configured and dimensioned in a variety of configurations. As shown in FIGS. 13 and 14, the exemplary embodiment includes four uniformly spaced and radially oriented venting ports 96 which connect the central passage 80 to the base portion 84.

Figure 15:
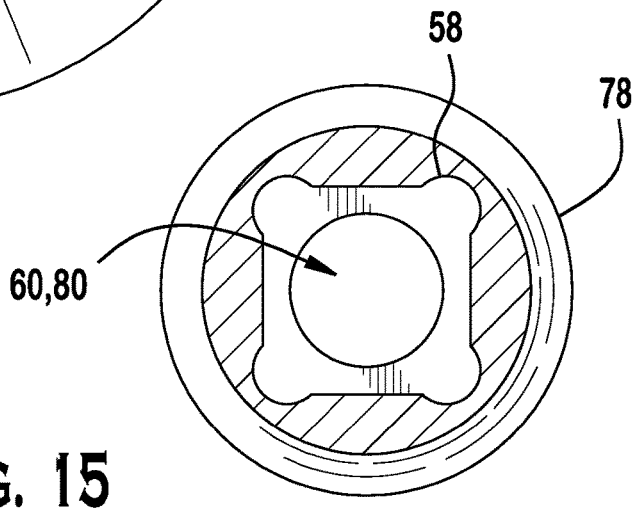
FIG. 15 is a cross-sectional view of the interior component of FIG. 11 along line 15-15.

Referring to FIG. 12 and FIG. 15, the bore 60 of the core may be axially and concentrically aligned with the receptacle 56, and further may fluidly connect the one or more radially oriented venting ports 96 with the interior conical surface 118 of the blast baffle. The intermediate segment 94 of the central passage 80, therefor, may extend from the proximal end of the bore 60 to the distal end of the bore. In the disclosed embodiment, the distal end of the bore 60 intersects the interior conical surface of the blast baffle to form a discharge port 120. Thus, the distal segment of the internal passage may extend from the discharge port to the trailing annular surface 112 at the distal end 68 of the core. Table 2A (below) present values for the dimensions of exterior features of the exemplary core.

TABLE 2A

| Exemplary Core Dimensions - Exterior Features | | | | | | | | | | | |
|---|---|---|---|---|---|---|---|---|---|---|---|
| | L5 | L6 | L7 | L8 | L9 | L10 | L11 | D5 | D8 | D10 | D11 |
| Value | .100 | .575 | .247 | .344 | .104 | .560 | .165 | .750 | .250 | 1.397 | .600 |

(a) Distances are provided in inches and the angle is provided in degrees.

As shown in FIG. 5, the proximal end 42 of the core may form a complementary surface which engages with the conical segment 66 to center the shroud 14 about the barrel 18 and clamp the shroud between the proximal end 42 of the core 16 and the flat annular surface 48 adjacent to the muzzle end. Hence, the core 16 may push against the shroud 14 via a taper on the shroud against the stopping surface 48 of the barrel and torqued into place to ensure the muzzle booster 12 is secured in place. As previously described, a screw thread 116 on the sidewall of the receptacle 56 may be configured and dimensioned to mate with the threaded portion 52 of the host firearm barrel 18. In this manner, the proximal end 42 of the core and the proximal end 40 of the shroud may cooperate with a firearm barrel 18 to form a taper lock mounting system 122 for securing a device for regulating firearm discharges gases to a firearm.

Additionally, other devices may incorporate a taper lock system 122. For instance, a suppressor formed from an exterior housing and a separable monocore structure—including a plurality of baffles—may be configured and dimensioned to cooperate with a threaded barrel segment to from a taper lock mounting system for centering and securing the suppressor to a firearm. Moreover, the interior component of the muzzle booster (or other firearm arm discharge gas regulating device) may include a multi-piece construction which may be derived from two or more pieces. Thus, an interior component including a two-piece construction may form an integrated mounting system that axially, angularly, and concentrically self-aligns the components when tightened.

Figure 9:
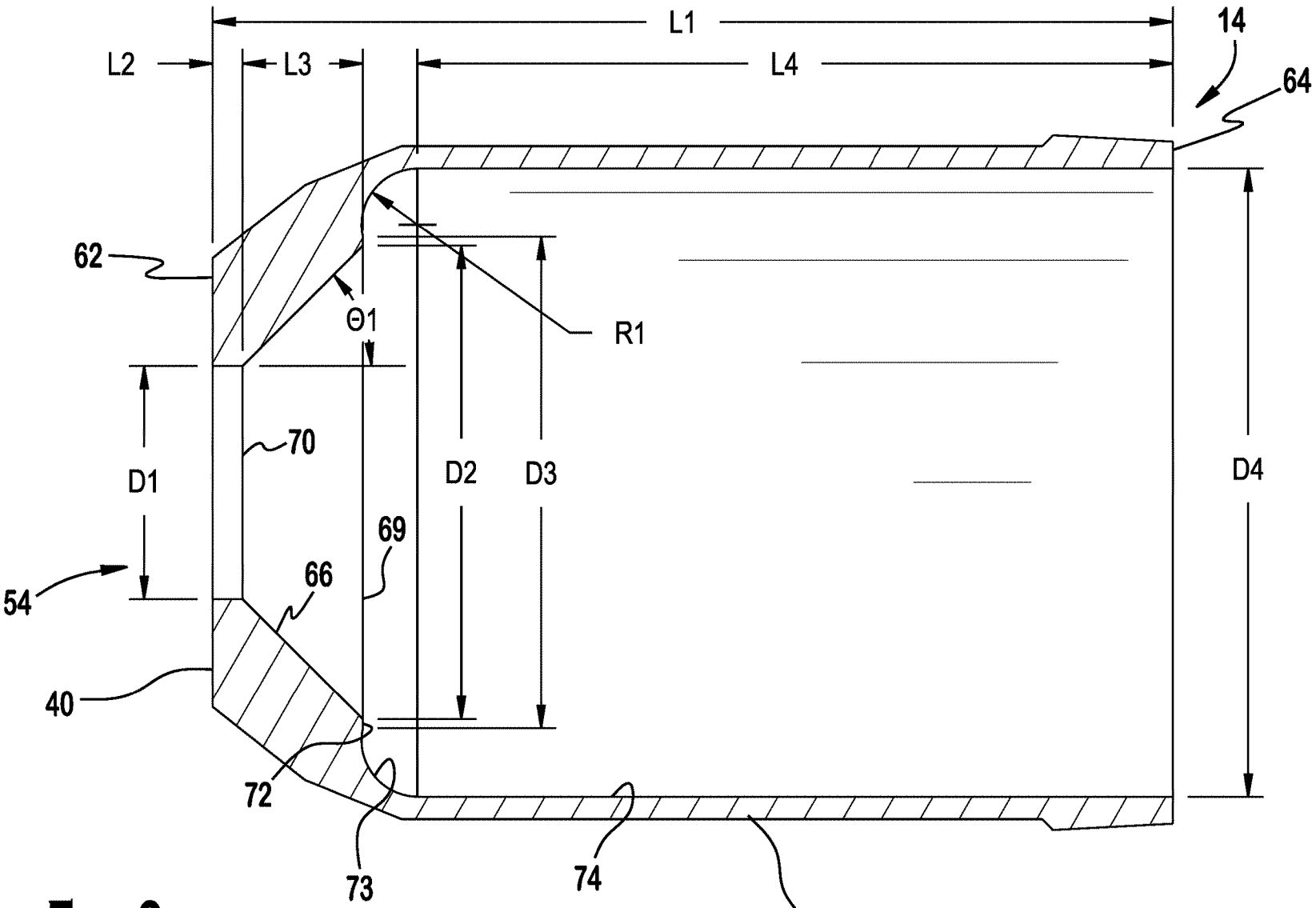
FIG. 9 is a cross-sectional view of the muzzle booster housing of FIG. 8 along line 9-9.

Referring to FIG. 9 and FIG. 12, the inner diameter D4 of the shroud 14 may be greater than the outer diameter D10 of the distal ring segment 110 of the core. A gap 126, therefore, preferably may exist between the distal end 64 of the shroud and the distal end 68 of the core 16 (FIG. 5). Preferably the gap 126 is substantially equal to 0.004 inches. In use, the muzzle booster 12 may eject discharge gases through the gap 126, as well as through the discharge port 120 of the bore. Emission of discharge gases through the gap may further modulate the backpressure generated by muzzle booster and enhance operational characteristics of the firearm, including by directing the discharge gases away from the operator.

Referring to FIG. 6, the volume of the void 124 (in view of the size, shape, orientation, and numeration of the venting features and relative to the configuration of the host firearm i.e., barrel length, gas system length, and the cartridge the firearm is chambered in) may be configured and dimen- Table 2A (below) present values for the dimensions of interior features of the exemplary core.

TABLE 2A

| Exemplary Core Dimensions - ~~Exterior~~ Interior Features | | | | | | | | | | | | | |
|---|---|---|---|---|---|---|---|---|---|---|---|---|---|
| | L5 | L6 | L7 | L8 | L9 | L10 | L11 | D42 | D6 | D8 | D10 | D11 | Θ2 |
| Value | .100 | .575 | .247 | .344 | .104 | .560 | .165 | .500 | .280 | .250 | 1.397 | 0.60 | 30.0 |

(a) Distances are provided in inches and the angle is provided in degrees.

sioned to affect the efficiency of the device with reference to modulating pressure waves, increasing the cyclic rate of autoloading firearms, increasing sound signature suppression, decreasing flash signature, reducing recoil, or affecting general operating characteristics of the firearm. For instance, in the disclosed embodiment, the void—exclusive of the venting ports—may form a blast chamber 124. The blast chamber 124 may possess a blast chamber volume. In use, discharge gases may enter the blast chamber via the venting ports 96, and then exit the blast chamber 124 via the gap 126 and the bore 60. In the disclosed embodiment, the bore is approximately 0.280 inches in diameter and the blast chamber volume is approximately 1.622 cubic inches. One particular example would be for a firearm chambered in 5.56× 45 mm NATO with a 5.5 inch barrel, a muzzle booster volume (or blast chamber volume) of approximately 1.622 cubic inches and a D6 value of 0.280 inches. A second example with the same barrel and cartridge would be to use a muzzle booster volume (or blast chamber volume) of approximately 0.950 cubic inches and a D6 value of 0.375 inches. Both of these illustrative embodiments may have the same back pressure and may demonstrate identical general operating system mechanics. Notably, for these examples, it is assumed that atmospheric deviations are neglected because temperature and pressure significantly may effect a cartridge's efficiency to burn it's charge.

Hence, the muzzle booster 12 may be configured and dimensioned to modulate a pressure wave of exhaust gases exiting the barrel 18 that were generated from the detonation of a specific type of ammunition cartridge in the chamber of the host firearm. Still, the bore 60 under certain conditions may be resized to accommodate the passage of another caliber of bullet or load of the same from a specific type of ammunition cartridge which is different from that for which the muzzle booster 12 was originally adapted. For example, a resized bore may have a diameter that is greater than the maximum outer diameter of the original bore. As the diameter D6 of the resized bore may affect the amount of backpressure created by the muzzle booster, the volume of the blast chamber may require adjustment for different calibers of ammunition in order to deliver a similar (or desired) level of backpressure to the firearm's operating system's characteristics. Accordingly, a change in the diameter D6 of the bore 60 may require a change to the contour of the outer surface of the core 16 and/or the inner surface of the shroud 14 to adjust the volume of the blast chamber 124. For example, an increase in the diameter D6 of the bore may require a decrease in the volume of the blast chamber to maintain a desired back pressure. The muzzle booster, however, may be tuned for a particular ammunition cartridge provided that the tuning factor is within the targeted zone, which may be approximately 85% to 115% of a tuning factor value as determined for a given barrel length and operating system configuration as previously described. More particularly, the tuning factor value for a particular cartridge having particular bullet diameter, particular muzzle booster internal volume (or blast chamber volume), and particular D6 value is for achieving a tuned autoloading system that is defined by having enough back pressure to reliably cycle the system and not over cycle the system so as to decrease the mean rounds between failure and increase maintenance and parts wear of the operating mechanism. Table 3 (below) presents a tuning factor value and range for the disclosed embodiment on a host firearm—MDX 505 PDX in 5.56×45 mm—, as well as for three other specific types of ammunition cartridges.

TABLE 3

Tuning Factor Target Ranges for Various Cartridges

| Cartridge | Volume of Blast Chamber [in3] | Gap [inches] | Diameter of Bore [inches] | Diameter of Bullet [inches] | Tuning Factor (TF) [inches2] | TF Target Value Low | TF Target Value High |
|---|---|---|---|---|---|---|---|
| 5.56 × 45 mm | 1.6222 | .056 | .280 | .224 | 28.967 | 24.6227 | 33.3130 |
| 7.62 × 39 mm | 1.6222 | .016 | .328 | .312 | 101.387 | 86.179 | 116.595 |
| 9 mm | 1.6222 | .040 | .395 | .355 | 40.555 | 34.471 | 46.638 |
| 300 BLK | 1.6222 | .020 | .328 | .308 | 81.110 | 68.943 | 93.276 |

Figure 7:
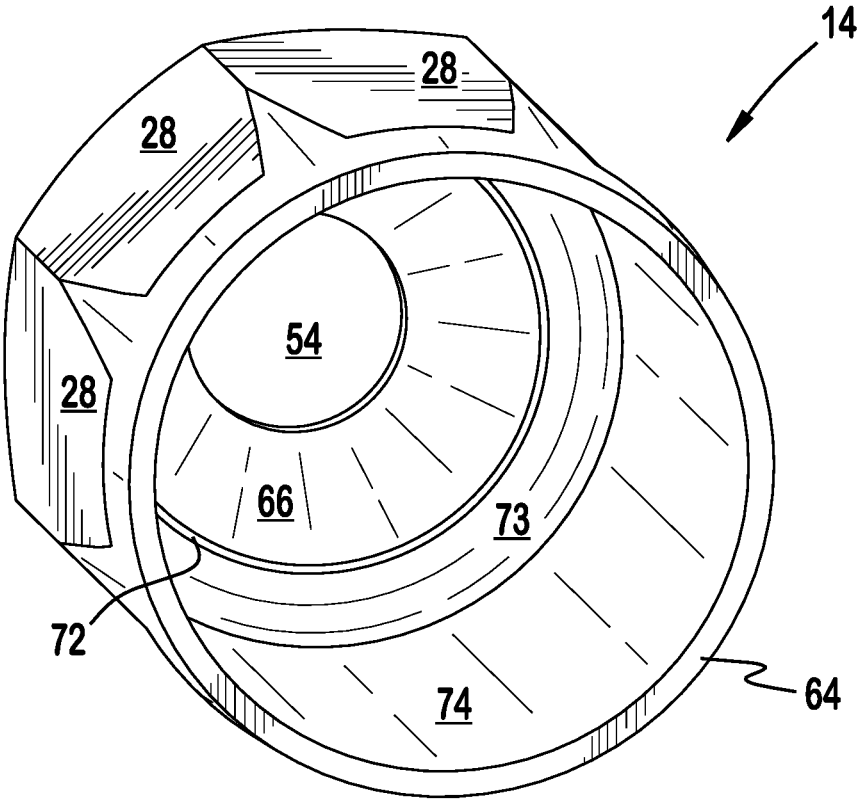
FIG. 7 is a perspective view of the muzzle booster housing of FIG. 1.
Figure 8:
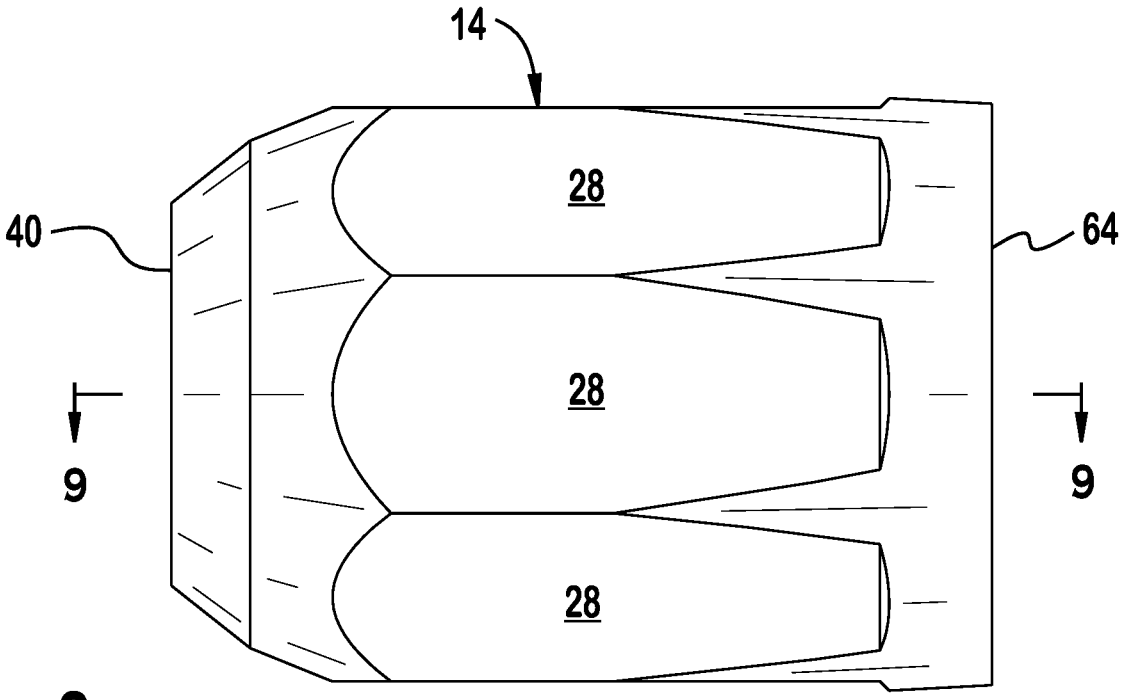
FIG. 8 is a side view of the muzzle booster housing of FIG. 7.

Notes:
(a) Tuning factor = Muzzle Booster Volume/Gap (Diameter of Bore (D6) − Diameter of Bullet) [inches2];
(b) Host firearm: Model no. MDX 505 PDX in 5.56 × 45 mm Referring to FIG. 7 and FIG. 8, flat regions (or flats) 28 may be milled radially about the external surface of the shroud (or housing). For example, the flats 28 may be configured and dimensioned such that when the device 12 is mounted on a barrel 18 of a firearm 10 that has a handguard 20 that protrudes beyond the muzzle 44 of the barrel and is equipped with an attachment interface system (e.g., M-LOK® compatible or other modular locking accessory mounting system), the screws of the attached devices can fully tighten without bottoming out on the external surface of the device. Alternatively, the shroud (or housing) 14 may be formed to achieve a similar result without flat regions being milled into the external surface of the housing.

In use, the muzzle booster may be mounted on the barrel of a firearm. The muzzle booster may include a shroud and an interior component. The interior component may include a blast baffle that is configured and dimensioned to provide internal and external geometries such that exhaust pressure within the gas system is extended as a function of time to increase the overall minimum pressure impulse from the gas system into the operating mechanism of the host firearm. The blast baffle or interior component may be of M baffle type, K baffle type, or other baffle design, including monocore designs, or baffle designs integrated into monocore designs. The shroud and the interior component may cooperate with the barrel of the host firearm to form a taper lock system for securing the muzzle booster or device to the host firearm barrel. Discharge gases may be directed through the core and into the space between the shroud and the core, as well as through the bore of the muzzle booster. The discharge gases may and the receptacle and for reducing flash signature, reducing sound signature, reducing shooter perceived recoil, increasing accuracy of the host firearm, and improving reliability of host autoloading firearms. Further, the muzzle booster apparatus incorporates a method for mounting the same and similar devices to a firearm. In view of the above, an exemplary embodiment of an apparatus is disclosed that may affect operational performance and reliability of a host firearm by: (1) modulating a pressure wave produced by the exhaust gases from an ammunition cartridge to increase the cyclic rate of the firearm; (2) increasing the sound signature suppression of the host firearm; (3) decreasing the flash signature of the host firearm; (4) reducing the recoil to a shooter from the host firearm; (5) increasing the accuracy of the host firearm; or (6) further affecting general operating characteristics of the firearm.

While it has been illustrated and described what at present are considered to be preferred embodiments of the present invention, it will be understood by those skilled in the art that various changes and modifications may be made, and equivalents may be substituted for elements thereof without departing from the true scope of the invention. For example, although the exemplary embodiment of the muzzle booster disclosed herein is a two-piece construction, the muzzle booster may be formed from a three-piece, four-piece or other multiple number of components. Also, the disclosed two-piece construction (or other multiple piece constructions) may be incorporated into other weapon accessories including, without limitation, suppressors, silencers, sound moderators or other devices and equipment. Moreover, features and or elements from any disclosed embodiment may be used singly or in combination with other embodiments. Therefore, it is intended that this invention not be limited to the features disclosed herein, but that the invention include all embodiments falling within the scope and the spirit of the present disclosure.

What is claimed is:

1. A muzzle booster for regulating discharge gases from a firearm, the muzzle booster comprising:
- a shroud which comprises
  - a first proximal end,
  - an interior conical segment adjacent the first proximal end, and
  - a first distal end which comprises a first diameter; and
- a core positioned in the shroud, the core comprising
  - a receptacle which comprises a first screw thread,
  - a venting port disposed adjacent to the receptacle,
  - a bore opposite the receptacle and concentrically aligned with the receptacle, and
  - a blast baffle disposed around the bore, the blast baffle comprising
    - a second distal end,
    - an internal cone adjacent to the second distal end, the bore and the internal cone being in fluid communication, and
    - a ring segment adjacent to the second distal end, the ring segment and the first distal end being spaced from each other radially by a gap, the gap being substantially equal to 0.004 inches, the core and the shroud defining a blast chamber intermediate to the shroud and the core.

2. The muzzle booster of claim 1, wherein the core further comprises a second proximal end and a leading conical segment adjacent to the second proximal end, the leading conical segment being seated within the interior conical segment.

3. The muzzle booster of claim 2, wherein the leading conical segment and the interior conical segment comprise an interface between the shroud and the core, and the interface is shape complementary.

4. The muzzle booster of claim 1, wherein the shroud further comprises a central aperture extending from the first proximal end to the interior conical segment.

5. The muzzle booster of claim 4, wherein the receptacle is concentrically aligned with the central aperture.

6. The muzzle booster of claim 1, wherein the internal cone comprises a drive socket.

7. The muzzle booster of claim 6, wherein the drive socket is a ⅜" square fitting.

8. The muzzle booster of claim 1, wherein the bore comprises an internal diameter of 0.280 inches.

9. The muzzle booster of claim 1, wherein the bore comprises an internal diameter of 0.395 inches.

10. The muzzle booster of claim 1, wherein the bore comprises an internal diameter of 0.328 inches.

11. The muzzle booster of claim 1, wherein the blast chamber volume is approximately 1.622 cubic inches.

12. The muzzle booster of claim 1, wherein the blast chamber volume is approximately 0.950 cubic inches.

13. An apparatus for regulating discharge gases from a firearm comprising:
- a muzzle booster of claim 1; and
- a barrel for a firearm, the barrel comprising a third distal end, an annular surface spaced from the third distal end, and a second screw thread adjacent to the annular surface and the third distal end, the barrel being arranged in the receptacle such that the second screw thread is mated to the first screw thread, and such that the shroud is clamped between the annular surface and the core.

14. The apparatus of claim 13, wherein the apparatus comprises a tuning factor of 86.179 square inches to 116.595 square inches.

15. The apparatus of claim 13, wherein the apparatus comprises a tuning factor of 68.943 square inches to 93.276 square inches.

16. The apparatus of claim 13, wherein the apparatus comprises a tuning factor of 34.471 square inches to 46.638 square inches.

17. The apparatus of claim 13, wherein the apparatus comprises a tuning factor of 24.622 square inches to 33.313 square inches.

18. The apparatus of claim 13, wherein the barrel is a 5.5 inch barrel.

19. A method for improving operational reliability of an autoloading firearm system, the autoloading firearm system including a barrel, the method comprising:
- providing a muzzle booster of claim 1; and
- fixing the muzzle booster to the barrel.

* * * * *